US006305110B1

(12) United States Patent
Chang

(10) Patent No.: US 6,305,110 B1
(45) Date of Patent: Oct. 23, 2001

(54) INTERCHANGABLE MODULAR PROGRAMMABLE NEON SIGN

(76) Inventor: Sheldon Chang, 442 Locust St., Mount Vernon, NY (US) 10552

( * ) Notice: Subject to any disclaimer, the term of this patent is extended or adjusted under 35 U.S.C. 154(b) by 0 days.

(21) Appl. No.: 09/192,549

(22) Filed: Nov. 13, 1998

(51) Int. Cl.[7] ..... G09F 13/04

(52) U.S. Cl. ..... 40/576; 40/545; 40/552; 345/42

(58) Field of Search ..... 40/545, 552, 576; 345/34, 42, 47

(56) References Cited

U.S. PATENT DOCUMENTS

| | | | | |
|---|---|---|---|---|
| 2,515,757 | * | 7/1950 | Browner | 40/545 |
| 2,540,271 | * | 2/1951 | Lytton | 40/545 |
| 2,853,819 | * | 9/1958 | Leesch | 40/545 |
| 3,413,631 | * | 11/1968 | Carey et al. | 345/34 |
| 3,715,744 | * | 2/1973 | Ito et al. | 345/42 |
| 3,918,041 | * | 11/1975 | Mao | 345/34 |
| 3,991,552 | * | 11/1976 | Ho et al. | 345/42 X |
| 4,038,640 | * | 7/1977 | Lee et al. | 345/34 X |
| 4,250,504 | * | 2/1981 | Eichelberger | 345/42 |
| 4,262,292 | * | 4/1981 | Duley | 345/34 |
| 4,263,736 | * | 4/1981 | Beierwaltes et al. | 345/34 X |
| 4,462,026 | * | 7/1984 | Munday | 345/34 |
| 4,471,350 | * | 9/1984 | Chow | 40/545 X |
| 4,570,160 | * | 2/1986 | Imazeki et al. | 345/34 |
| 4,629,946 | * | 12/1986 | Amano et al. | 40/545 X |
| 4,949,487 | * | 8/1990 | Kibarer | 40/552 X |
| 4,998,365 | * | 3/1991 | Bezek | 40/545 |
| 5,420,600 | * | 5/1995 | Strobel et al. | 345/34 X |
| 5,453,668 | * | 9/1995 | Chow | 315/307 |
| 5,621,991 | * | 4/1997 | Gustafson | 40/552 X |

* cited by examiner

*Primary Examiner*—Anthony Knight
*Assistant Examiner*—Andrea Chop
(74) *Attorney, Agent, or Firm*—Kilgannon & Steidl

(57) ABSTRACT

A modular neon sign control system with a plurality of discrete neon letters, numbers or symbols, each with plugs to plug into at any place along a continuous electrical rail. Each neon letter, etc. is a single tube having its own driving inverter and digital decoder. Dip switches set a unique digital code into the decoder for each letter. A programmed memory controls a system encoder which sends coded signals to each decoder to compare with each letter's unique code. Those letters receiving the matching digital signals are activated or deactivated according to the program. The letters, etc. of the sign can be operated simultaneously, serially, randomly, in a pattern, or in a flashing manner. Power from an ac adapter is supplied along with the signals from the encoder to the electrical rail, and the decoder separates the power from the coded signals. The letters may be individually and easily prearranged and substituted in a sign.

9 Claims, 5 Drawing Sheets

INTERCHANGABLE MODULAR PROGRAMMABLE NEON SIGN

FIELD OF THE INVENTION

This invention relates to neon signs, more particularly to a neon sign formed of a plurality of individual letters, numbers and/or symbols.

BACKGROUND OF THE INVENTION

Neon signs of multiple letters, numbers and/or symbols traditionally have been made in various forms. In one version, a single continuous length or series of connected lengths of neon tubing form all the elements (letters, numbers and/or symbols) of the neon sign. In another version, individual lengths of tubing form part of and are assembled into each whole letter, number or symbol of the sign. In a further version, individual lengths of tubing are utilized, each of which makes up a whole letter or number.

In the case of the continues length (or series of connected lengths) of tubing, failure of any part of the tubing renders the whole sign, or major parts thereof, inoperable, this generally requiring removal, repair and reinstallation of the sign with consequential underdesirable down-time for the sign. Further, the sign is fixed in the form in which it is manufactured, and the individual letters, numbers and/or symbols cannot be individually varied or replaced to thereby form a new sign.

In the case of individual lengths of tubing that form segments of and are assembled into each whole letter, number or symbol of the neon sign, individual segments that fail can be replaced by unfastening such from support structure and replacing with a new segment. However, neon signs of such design are cumbersome, time consuming and expensive to install, inasmuch as up to seven separate segments of tubing, or multiples thereof, make up each letter, number and/or symbol. Each separate segment of a letter, number and/or symbol also requires a separate power connection, there thus being several power connections to each letter, etc. In some instances of such segmented letters, numbers and/or symbols, electrical signals may be switched to turn on only some of the segments of each letter, etc., thus forming different letters, numbers and/or symbols depending on which of the seven discrete neon segments are energized. The circuitry is also complex and extensive since there are large numbers of neon tube segments involved in a sign of numerous letters, etc.

In the case of neon signs wherein each letter, number and/or symbol is formed of a single length of neon tubing, current has been supplied to the letters, etc. from an external common high voltage transformer or by an individual transformer in each letter, etc. Heretofore, elaborate mechanical and electrical mounting and operating means have been required for such signs. The letters are bolted or secured into the electrical tracks or into each other, and thus replaced in the same manner. The letters generally are all turned on and off together, so that the resultant sign does not have a great deal of versatility in its operation.

SUMMARY OF THE INVENTION

The present invention is intended to overcome the deficiencies of the above-noted neon sign designs. A neon sign is disclosed having each separate element (letter, number or symbol) formed of a single neon tube. Each tube at its opposite ends extends into a box for that tube which contains a discrete inverter circuit for that tube and a discrete decoding and control circuit for the inverter. Means are provided to manually program and store a unique digital code for the particular tube element (letter, number or symbol) into the decoding circuit. Different letters, etc. for each sign accordingly will each have their own unique programmed and stored code.

A continuous electrified rail is provided, and prongs extend from the rear of each box to easily plug that particular letter, etc. into the rail. The electrified rail provides power and coded signals from a controller to each box and thus to each letter, the decoding circuitry in each box separating the power and coded signals. If the controller sends out a particular code for a particular letter, the decoding means for that letter will compare the stored and programmed code in the decoder with the code from the controller. When they match, the decoding circuitry tells the inverter to turn on or off the particular letter connected thereto. Those other letters of the sign whose stored and programmed unique codes do not match the code from the controller will not activate (or deactivate).

The controller is powered from an AC adapter. The controller contains a clock generator, a counter, a memory for storing the program for the letters, numbers or symbols of the sign in question, and an encoding circuit to generate the coded signals sent to the electrified rail and to the discrete decoding circuits for the each discrete letter in the sign.

Accordingly, the present invention provides for separate letters, etc. being individually purchasable to make up whatever sign the user wishes to design. Thus, the ability to design any sign is essentially unlimited. Each letter, etc. is mechanically and electrically discrete so that the letters are not connected to one another. The letters, etc. by virtue of the prongs at the back of each, can be easily inserted and spaced at any desired spacing along the electrified rail. Likewise, the letters can be easily removed and/or rearranged at different positions to form new words with other letters. Any letter in the sign also can be of a color different from other letters. Defective letters are also easily and instantly replaceable.

A further particularly advantageous feature of the present invention is that the discrete coding for each letter etc. allows a sign of several letters, numbers, or symbols to have its letters activated/deactivated at the same time, serially, in random order, by flashing on and off, in a patterned fashion, etc. to attract the attention of the viewer. Constantly shifting visible patterns may also be utilized to attract attention. The controller and its program determine when and if each letter, etc. is turned on and off, thus providing a neon sign with great versatility.

Other features and advantages of the present invention will be apparent from the following description, drawings and claims.

DETAILED DESCRIPTION OF EMBODIMENTS

Figure 1:
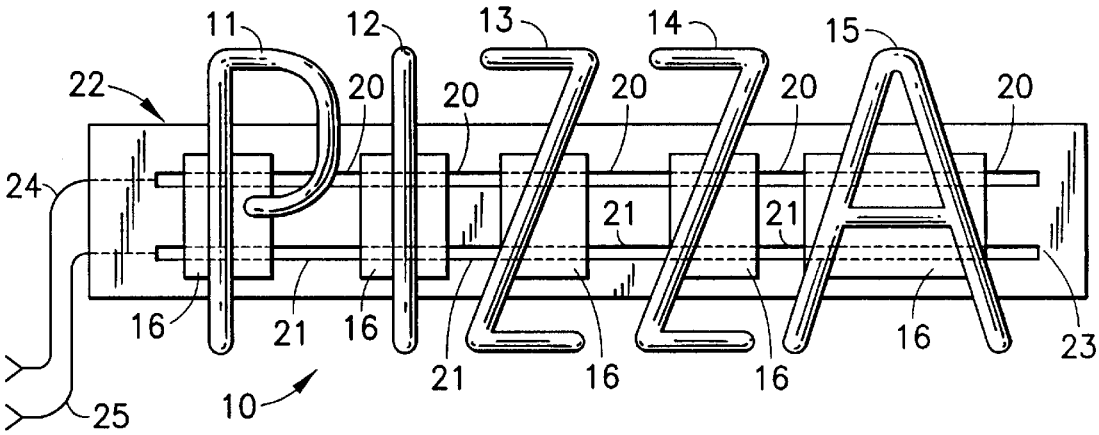
FIG. 1 is a front elevational view of the modular system of the present invention, illustrating discrete neon letters connected to the power rail.

Referring to FIG. 1, modular neon sign system 10 is shown comprised of individually discrete neon letters 11,12, 13,14 and 15 by way of example. Each letter is formed of a single glass or plastic tube, bent and configured to form the desired letter (or symbol or number). It is contemplated that all commonly used letters/numbers/symbols will be provided as individually discrete neon elements under the present invention, to be bought and assembled by the owner into one or more desired neon signs of the owner's choosing.

Figure 2:
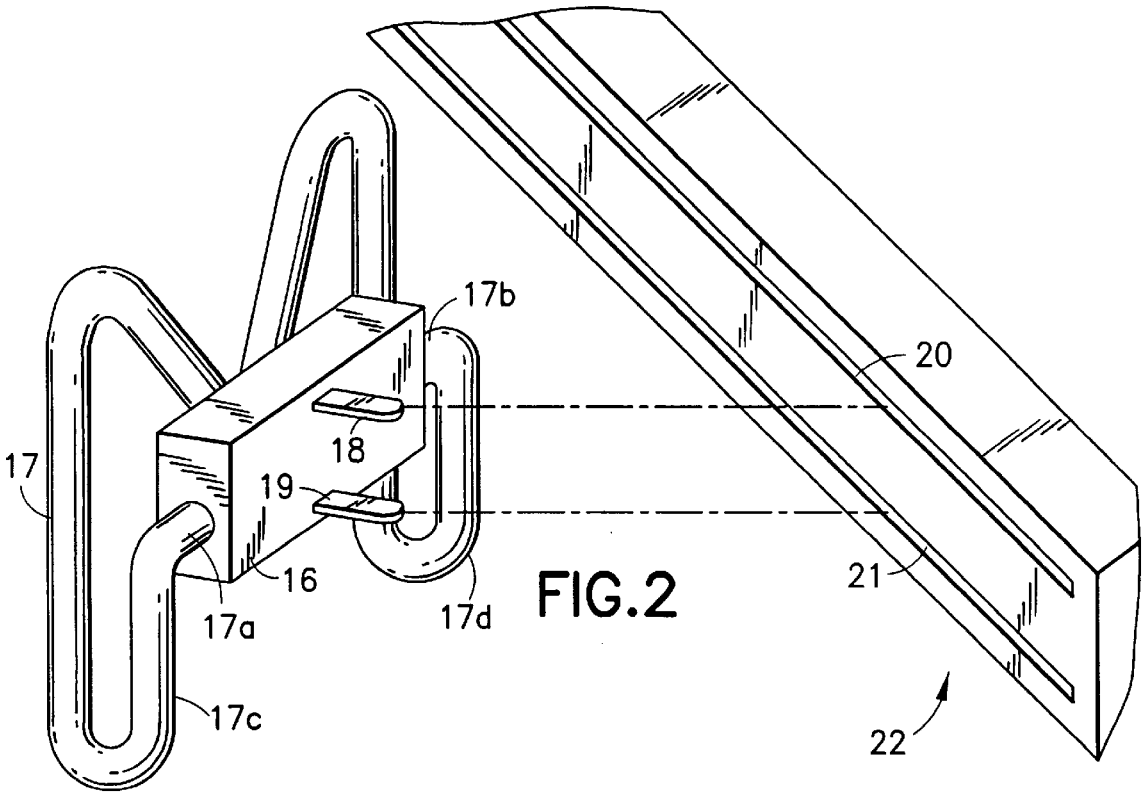
FIG. 2 is a rear perspective view of a discrete neon letter of the present invention, illustrating how the letter can be plugged into the power rail.

Referring further to both FIGS. 1 and 2, each letter formed as a single neon tube has the opposite ends of the tube extending into a receptacle or box 16. FIG. 2 shows at 17 the back side of the letter "M" in perspective, the opposite ends 17*a* and 17*b* of tube 17 extending into box 16. The portions 17*c* and 17*d* of the neon tube 17 not defining the letter "M" extend behind the tube portions defining the "M" and are made opaque so that these portions are not visible to one viewing the front of the "M" in a sign. The same is true of each letter in FIG. 1, wherein the portions of each tube not forming the visible letter, including the end portions of each tube extending into its box 16, are opaque and thus not visible to one looking at the neon sign from the front. This opaqueness may be accomplished by coating the tube of each letter with a dark paint or plastic material at the portions of the tube not intended to pass light to the observer (i.e., portions 17*c* and 17*d* in FIG. 2.).

Figure 4:
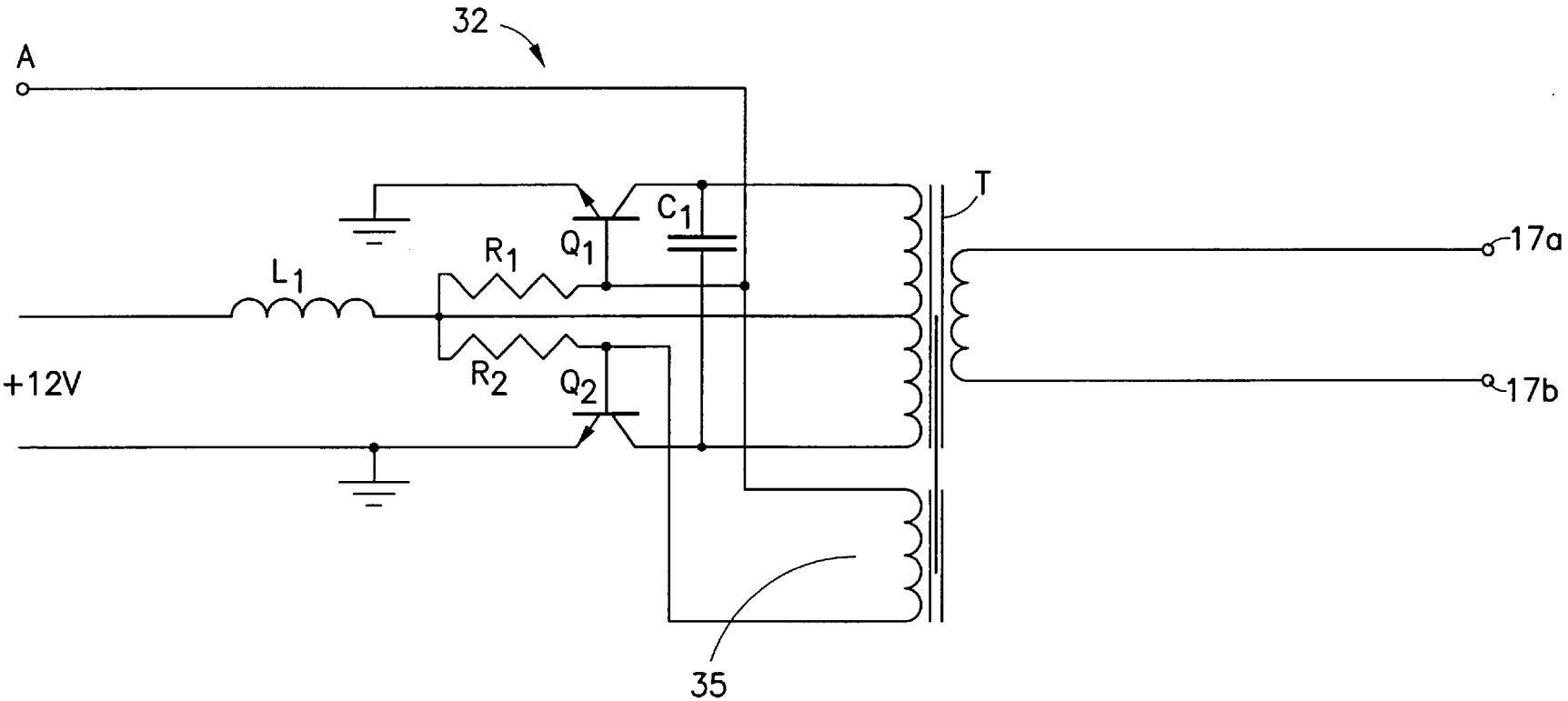
FIG. 4 is a circuit schematic illustrating the discrete power circuit for each discrete neon letter.
Figure 5:
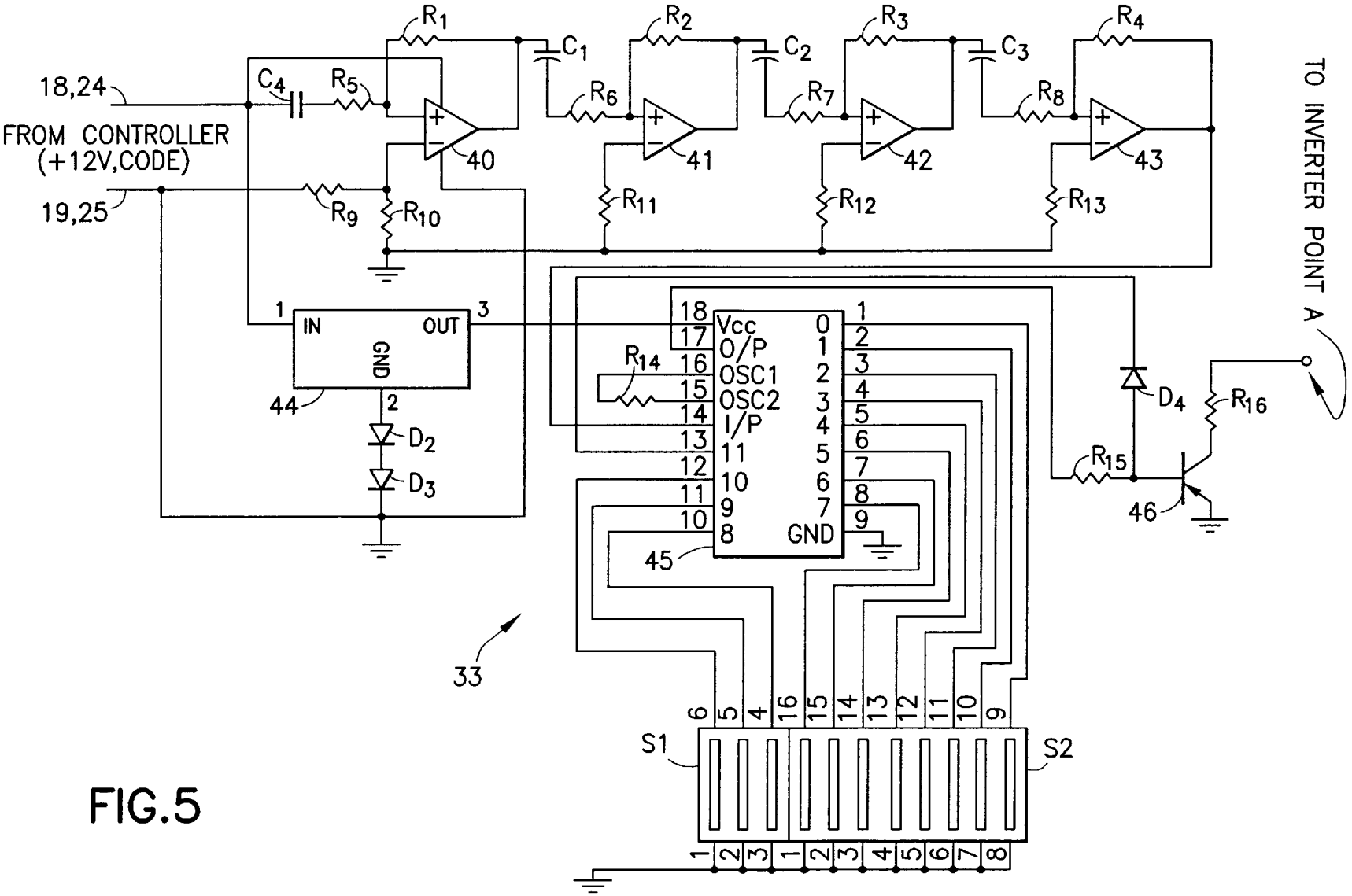
FIG. 5 is a circuit schematic illustrating the discrete decoding and control circuit for each discrete power circuit and neon letter of FIG. 4.

Each box 16 contains electrical circuitry therein as shown in FIGS. 4 and 5, being the discrete power circuit and the discrete neon decode and control circuitry for each neon letter. The conventional gas in each neon letter is energized at the two ends of each tube extending into each box 16. Boxes 16 may be standardized if desired so that the opposite ends of a tube forming a letter will plug into the box 16 at two openings identically positioned in each standardized box 16, even though the letters will be different; in this event, the opaque ends of each tube are bent as needed upon manufacture to fit the standardized box. Extending from the rear of each box 16 are electrical prongs 18,19. As shown in FIGS. 1 and 2, prongs 18, 19 respectively plug into continuous energized slots 20,21 of electrical rail or strip 22. Slots 20,21 contain continuous electrical track contacts along the slots which at one end 23 of rail 22 are terminated, and at the other end are connected to electrical means 24,25, for example 2 pair AWG #20 wire. If desired for a larger sign with more letters, one or more additional rails 22 may be electrically connected into rail 22 at end 23, the additional rails in effect forming an extension of rail 22 for the additional letters to operate in the same manner. These additional rails may be positioned alongside, above, below, at an angle or perpendicular to rail 22.

It will thus be seen from the above description of FIGS. 1 and 2, that each neon letter is a discrete unit connected to a discrete box 16 for each letter, and accordingly that each individual letter as a whole is a modular unit that can easily be plugged into rail 22 via prongs 18,19 and slots 20,21 at any position along rail 22. Thus, individual letters can be plugged in, rearranged, spaced as desired along the rail, and removed including for repair, thus providing a modular system of great versatility. Since the letters are individually modular, they can also be of different colors and designs. Letters can be individually bought by the purchaser to make up his own sign, without requiring skilled professional neon sign installers. It should be understood that the reference to letters in this application also is meant in each case to encompass numbers or symbols.

When power is applied to rail 22 via conductors 24 and 25, there is electrical power provided to the prongs 18,19 of each box 16 of each neon letter plugged into rail 22. Whether or not a given letter is energized, however, depends upon whether the particular code that a letter has been assigned and set for matches the particular letter-identifying code signal carried along with the electrical power signal on wires 24 and 25. Accordingly, in a neon sign of the present invention with a plurality of discrete coded neon letters, the individual letters may be sequentially or randomly turned on and off, flashed on and off all at the same time, or activated in a patterned fashion, etc., depending upon the digital codes assigned each letter and the electric code signals from a controller applied to each letter in the sign. Each letter generally can be set to its own unique code, and when the same letter appears twice in a given neon sign (for example, the two "Z's" in the "PIZZA" sign of FIG. 1), each of the identical letters can be set to a different code to allow sequential activation, for example.

Figure 3:
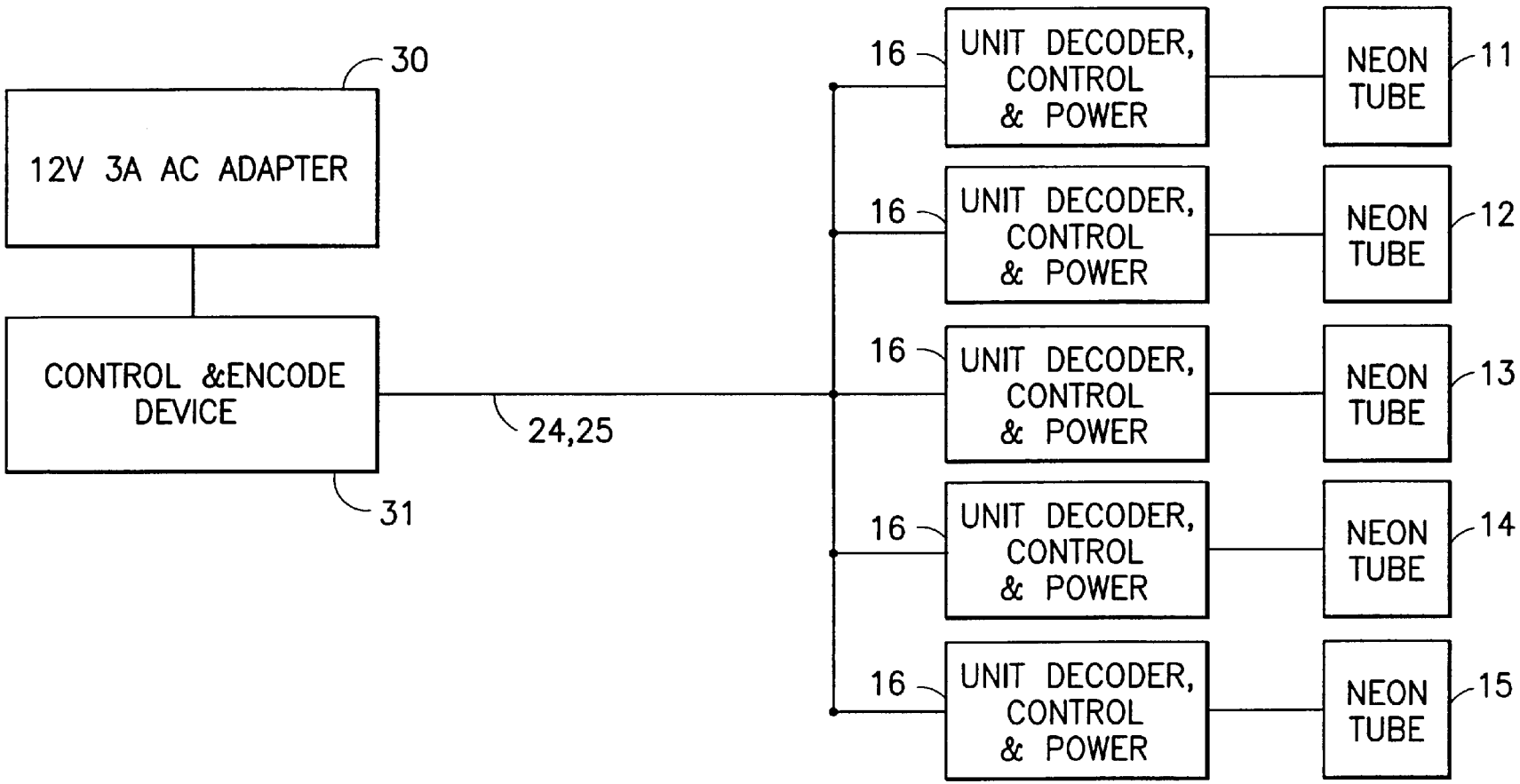
FIG. 3 is a block diagram of the system control and encode circuit, the decode and control and power circuits for each neon letter, and each neon letter of the modular system of the present invention.

Turning now to FIG. 3, a block diagram is shown for activating and controlling a modular neon sign of the present invention. A 12 volt, 3 amp AC adapter 30 plugs into a 120 volt AC power outlet and delivers the low DC voltage to power the circuitry. The adapter feeds power to the control and encode device 31 of FIG. 6, which in turn provides the power and control signals via wires 24,25 (for example, 2 pair AWG #20 wire, also see FIG. 1) to rail 22. Rail 22 provides these signals through prongs 18,19 to the neon decode and control circuits of FIG. 5 which are separately contained within each discrete box 16 to which a discrete neon letter is attached. Within each box 16 is also contained the DC inverter power circuit of FIG. 4 to power each letter if the neon decode and control circuit of FIG. 5 determines that the coding of an input signal to it matches the stored unique coding assigned to and set for the particular letter in question, in which event the FIG. 4 circuit is activated.

Referring to FIG. 4, a DC inverter circuit 32 is illustrated for each neon letter, providing output power of approximately 1000 volts at 30–40 kilohertz to the ends of a neon tube, for example ends 17*a* and 17*b* of tube 17 in FIG. 2. The circuit includes transistors Q1 and Q2 (for example, each a 2SC3669); inductor L1 (for example, 100 micro henries in value); resistors R1 and R2 (for example, each 1.5 k ohms in value); capacitor C1 (for example, 0.12 microfarads in value); transformer T; and voltage regulator feedback circuit 35. When a high signal is applied to point A of FIG. 4 from the circuit of FIG. 5, the inverter will turn on and energize its associated neon tube.

Referring to FIG. 5, neon decode and control circuit 33 indicates the signal feed to inverter point A, that signal depending on the operation of FIG. 5. As previously indicated, a circuit 33 is contained in each box 16 for each individual neon letter. Circuit 33 is fed from input lines 24,25 feeding rail 22 and thus prongs 18,19 of each box 16. The control and encode device 31 illustrated in FIG. 6 provides its output to these lines 24,25 as indicated in FIG. 6.

Referring back again to FIG. 5, four amplifiers 40,41,42 and 43 are illustrated, which may be a TL 084 quad operational amplifier chip used to separate the code signal input to the circuit 33 of FIG. 5 from the 12 volt DC power input to circuit 33. Chip 44 is a voltage regulator, for example a 78 M05 chip, which reduces the 12 volt input to a 5 volt output fed to chip 45 on pin 18. Chip 45 is a decoding chip, for example an HT-12F, which accepts the code signal from the amplifier 43 on pin 14. External resistor R14 between pins 15 and 16 is used for clock generation purposes. Within chip 45, a code is initially set for its discrete associated neon letter through pins 1–8 and 10–12. If a particular pin is connected to ground, chip 45 considers it a "O", whereas if a pin is floating or connected to Vcc, chip 45 considers it as a "1". As previously described, each chip 45 will have a particular code programmed into it that identifies the particular letter associated with that chip. The codes are programmed by dip switches S1 and S2, the three switches of S1, and the eight switches of S2 each providing a "o" or a "1" setting to the respective connected pins of chip 45 depending on how each switch is manually set. Thereafter, when a code signal from FIG. 6 is sent to each FIG. 5 circuit, each decoding chip in each FIG. 5 circuit for each letter compares the incoming code signal with the assigned code already programmed in each chip 45 through the dip switches S1 and S2. When a match occurs in a particular chip 45, that chip sends a high signal out from pin 17 via transistor 46 (for example, a 2SC 945) to inverter point A to energize via FIG. 4 the particular letter in question, as previously described. If the stored assigned code does not match the incoming code signal for a given letter, a high signal is not sent to inverter point A and the inverter will not light the particular neon tube.

As an example of the other respective circuit element values of FIG. 5, R15 and R16 may be 1K ohms; R1 and R5 through R13 may be 10K ohms; R14 may be 15K ohms; R2 through R4 may be 1M ohms; C1 through C3 may be 0.47 microfarads; and C4 may be 0.1 microfarad. Diodes D2 and D3 may each be an IN 4001, and diode D4 may be an 1N 4148.

Figure 6:
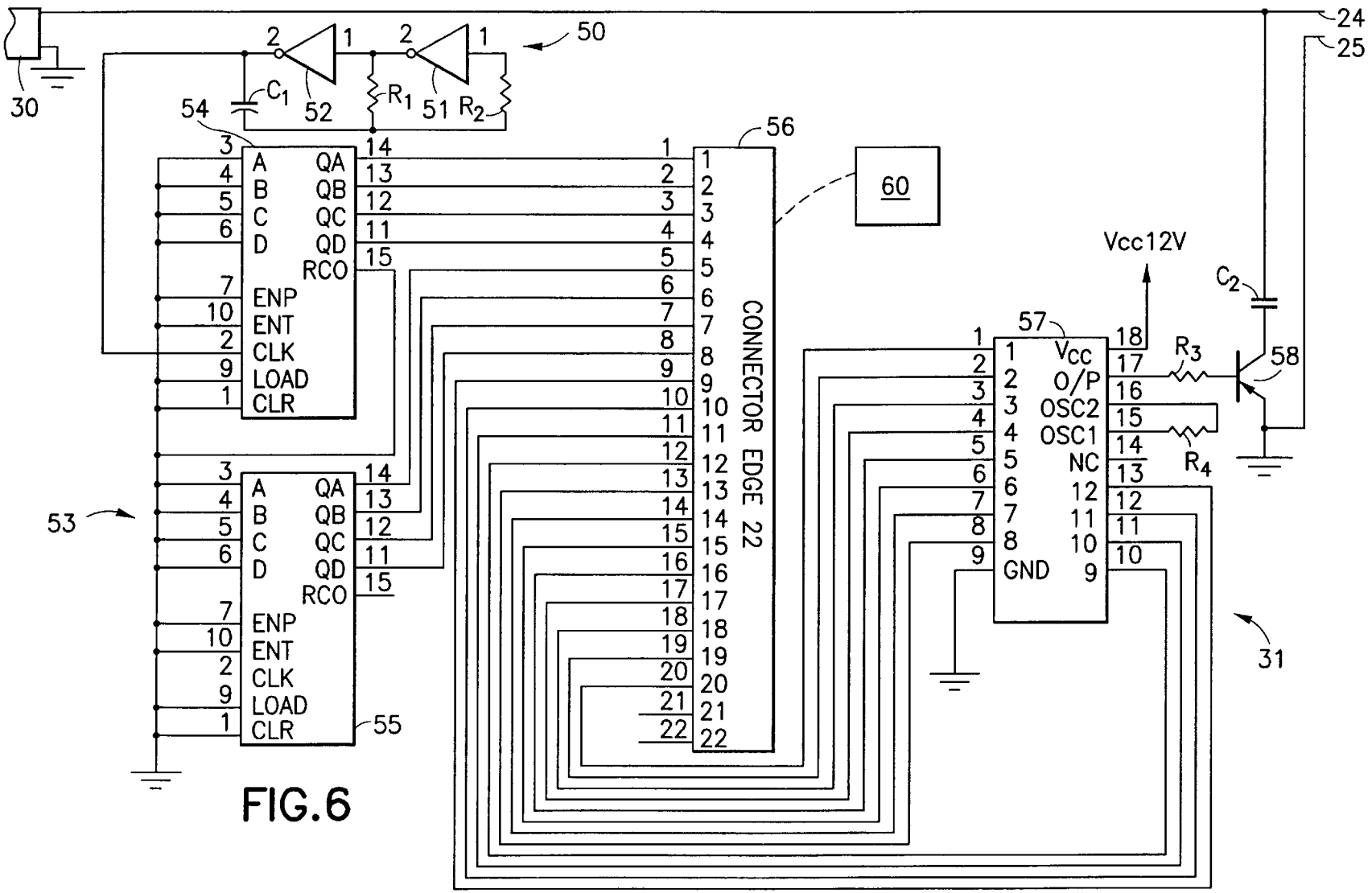
FIG. 6 is a circuit schematic illustrating the control and encode circuit for the entire modular system.

The control and encoding of the entire modular system of the present invention are provided by circuit 31 of FIG. 6 (also as shown in FIG. 3). Circuit 31 allows the owner of the sign to control the modular sign in a number of possible ways that he deems desirable. Circuit 31 includes a clock generator 50 comprised of inverters 51 and 52 which may be on a CD4069 chip; a counter 53 shown as a cascaded 8 bit counter comprised of chips 54 and 55, each of which may be a 74 HC 163; an edge connector 56 into which an external memory chip or chips 60 (diagrammatically shown) may be plugged; an encoding chip 57, which may be an HT-12E; and transistor 58 (for example, a 2SC 945) which outputs its signal to lines 24,25 (as does the 12 volt DC power supply).

As an example of the other respective circuit element values of FIG. 6, R1 may be 1M ohms, R2 may be 1M ohms, R3 may be 1K ohms and R4 may be 15K ohms. C1 and C2 may each be 0.1 microfarads.

Continuing to refer to FIG. 6, encoding chip 57 has an external oscillation resistor R4 connected between pins 15 and 16 to generate the required clock signal. Each code sent out from pin 17 of encoding chip 57 to transistor 58 is a signal of thirteen serial pulses which represents a starting bit telling the decoders of FIG. 5 (one for each letter) to start decoding, eleven further bits forming the particular letter code, and a final bit telling the particular letter to turn on or off. Each of the thirteen pulses represents a binary "O" or "1" depending on its width. Pin 1 to pin 8 respectively represent bit 1 to bit 8, and pin 10 to pin 14 respectively represent bit 9 to bit 13 of the signal. Connecting a bit pin to ground generates a "O" bit with a narrower pulse width in the code, whereas connecting a bit pin to Vcc or leaving it floating generates a "1" bit with a wider pulse width. The bit pins of encoding chip 57 are connected to a memory chip or chips 60 which may be programmed outside the circuit of FIG. 6 and inserted into the edge connector 56. The memory chip or chips 60 contains the data of when and which neon letters should turn on and off in a modular system of the present invention containing a plurality of neon letters. The memory chip or chips 60 also serves to encode the bit pins of encoding chip 57 prior to delivering a signal to lines 24,25. To retrieve memory from the memory chip the clock generator 50 is required as well as the counter 53 serving as the program counter for the memory chip. The counter 53 will provide the address bit needed by the memory chip, the memory content of that address then being provided to encode the encoding chip 57.

Now turning to a description of setting, encoding and decoding the FIGS. 5 and 6 circuits, for example a five letter modular system of discrete letters, a user who has bought the system including the five discrete letters will manually set a particular code in decoding chip 45 of each letter by means of the dip switches 51 and 52 of FIG. 5 (an eleven bit address being available). The user may decide that he wishes to have the first letter light up, thereafter the second and fourth letters light up together, thereafter the third letter light up, and finally the last letter light up. For example, the word "PIZZA" may be activated in this fashion to attract the attention of potential customers of a pizzeria. Following this sequence, the first letter is coded as 1000000000001 in binary and which is stored as thirteen bits at a first location in the memory chip referenced in regard to the above description of FIG. 6. (As noted above, the first bit is the "start" signal and the last bit is the "on" (or "off") signal). The second and fourth letters are coded as 1000000000011 at a second location in the memory chip. The third letter is coded and stored as 1000000000101 at a third location in the memory chip. The fifth letter is coded and stored as 1000000000111 at a fourth location in the memory chip. To operate the system, clock 50 generates a clock to counter 53 which then sequentially accesses the addresses of the memory.

When the first location of the memory is selected, the memory chip sends out its content which will code encoder chip 57 and output through pin 17 to decoder chip 45 of each letter. Since only the first letter will match this content with its set code, only the first letter will turn on as previously described although all decoder chips 45 of all letters have received the encoded signal. Likewise when the second location of the memory is selected, the memory chip sends out its content which will code encoder chip 57 and output through pin 17 to decoder chip 45 of each letter. Here, the second and fourth letters will match this content with the set codes, so that the second and fourth letters will turn on at the same time. The remaining operation for the third and fifth letters accordingly are self evident. Thereafter, when it is programmed to turn one or more of the letters off, the memory chip will send its code for that letter (s) to encode chip 57 and output through pin 17 to decoder chip 45 of each letter. The code will now include the "off" bit, and the decoder chip 45 that matches the particular code will remove the high signal from inverter point A. In this manner the sign can be turned off and on in any desired and programmed sequence of letters to attract attention.

It will be appreciated from the above description that a number of advantages flow from the present invention. The modular neon sign can be designed and assembled by the user merely by purchasing and plugging in the particular discrete letters needed for the word or words of the intended sign. The letters also can be easily rearranged and/or new letters can be substituted, to spell out different words. The discrete letters further may be reusable in a different sign at a later date. Additionally, various letters with different colors may be used in the same sign. Also, a defective letter can be changed without changing the other letters in the sign.

The separately programmable and modular letters of the present invention provide a sign with great versatility. The letters may be sequentially activated, simultaneously activated, flashed on and off, randomly activated, or activated in a controlled but not sequential manner, all as determined by the individual coding of each discrete letter and the programming/encoding/decoding/timing of the signals sent by the controller to each letter. Likewise, discrete numbers or symbols can be used in place of the letters in exactly the same fashion. In the case of symbols (geometric figures, etc.), they may be activated in any desired and programmed manner to provide constantly shifting visible patterns to attract attention.

The modular letters of the present invention may be mass produced and individually sold, thus allowing the economics of mass production to substitute plastic for glass as the tube material and thereby reducing the possibility of tube breakage inherent with glass. The signs will be safe, as not requiring very large power supplies associated with conventional neon signs, and will be light in weight since heavy transformers are not required, thus allowing the signs to be easily installed at most locations.

It will be appreciated by persons skilled in the art that numerous variations and/or modifications may be made to the invention without departing from the spirit and scope of the invention. The present embodiments are, therefore, to be considered as illustrative and not restrictive.

What is claimed is:

1. A modular neon light control system, comprising in combination: a plurality of discrete neon letters each formed of a single neon tube; an electrical rail having two electrical conductors which may be plugged into at a variety of positions; each neon letter having associated plug means to plug into the electrical rail; each neon letter having a separate inverter for providing power to the neon letter and a separate digital decoding and control circuit; means to provide DC power to each of the two electrical conductors and to each digital decoding and control circuit; means to provide coded letter control signals to each of the two electrical conductors and to each digital decoding and control circuit; each decoding and control circuit having means to set and store a particular code as a stored code identifying the letter, means to digitally compare the stored code with the coded letter control signals, and means to output an inverter control signal to the inverter when the stored code and coded letter control signals are identical; a control and encoder circuit for controlling the modular neon light system, having a clock generator, a memory, means for addressing said memory and means to encode a signal from memory; said means to encode a signal from memory having means to receive and encode information from the memory to form encoded information as to when and which of the plurality of neon letters is to be activated or deactivated and means to output the encoded information as coded letter control signals to said electrical conductors and each decoding and control circuit for each letter.

2. The system of claim 1, wherein each neon letter is a single plastic tube.

3. The system of claim 1, wherein each neon letter is a single glass tube.

4. The system of claim 1, wherein an AC adapter provides DC power to the modular system.

5. The system of claim 1, wherein two-pair wire connects the control and encoder circuit to each decoding and control circuit.

6. The system of claim 1, wherein each decoding and control circuit includes means to separate the DC power and coded letter control signals provided to the decoding and control circuit.

7. The system of claim 1, each letter being formed of a single neon tube, a separate receptacle associated with each tube containing the inverter and the decoding and control circuit for the letter, each neon tube having opposite ends, the opposite ends of each neon tube extending to walls of the receptacle, and plug means extending from the walls of the receptacle for plugging into the electrical rail.

8. The system of claim 1, wherein the electrical rail has continuous electrical tracks along which the associated plug means of each letter may plug in at any desired location.

9. The system of claim 1, wherein the means to set a particular code for each decoding and control circuit is a dip switch.

* * * * *